United States Patent [19]

Meyer

[11] Patent Number: 4,494,582

[45] Date of Patent: Jan. 22, 1985

[54] ICE CREAM MAKING AND PACKAGING SYSTEM AND METHOD

[75] Inventor: Jerome K. Meyer, West Valley City, Utah

[73] Assignee: Safeway Stores, Incorporated, Oakland, Calif.

[21] Appl. No.: 482,150

[22] Filed: Apr. 5, 1983

[51] Int. Cl.[3] ..... B65B 3/04

[52] U.S. Cl. ..... 141/9; 141/82; 141/83; 141/100; 177/50; 222/55; 366/161; 425/140

[58] Field of Search ..... 141/1-12, 141/82, 83, 100-107, 129-192; 222/1, 52, 55; 177/50, 52, 58, 25; 425/140, 145, 149; 366/161

[56] References Cited

U.S. PATENT DOCUMENTS

| | | | |
|---|---|---|---|
| 2,278,340 | 3/1942 | Weinreich et al. | 366/102 |
| 2,645,447 | 7/1953 | Clark et al. | 141/183 |
| 2,995,158 | 8/1961 | Oberg | 141/104 |
| 3,526,255 | 9/1970 | Carter | 141/183 |
| 3,648,741 | 3/1972 | Croasdale et al. | 141/83 |
| 3,665,980 | 5/1972 | Croslin et al. | 141/183 |
| 3,862,666 | 1/1975 | Muskat et al. | 177/50 |
| 4,054,784 | 10/1977 | Ricciardi et al. | 222/55 |
| 4,230,195 | 10/1980 | Graffin | 177/50 |
| 4,398,612 | 8/1983 | Seisakusho | 177/58 |
| 4,398,613 | 8/1983 | Hirano | 177/58 |

*Primary Examiner*—Houston S. Bell, Jr.

*Attorney, Agent, or Firm*—Flehr, Hohbach, Test, Albritton & Herbert

[57] ABSTRACT

Ice cream making machine and method which automatically controls the weight of ice cream supplied to containers by increasing or decreasing the amount of overrun, depending upon whether or not the cartons in a production line are overweight or underweight with respect to a desired target weight. Correcting signals are derived at a weighing station which are proportional in time to the amount or underweight of an average group of weighed packages. Such signals are applied to structure which adjust to the amount of air being supplied to the ice cream mix.

7 Claims, 3 Drawing Figures

ICE CREAM MAKING AND PACKAGING SYSTEM AND METHOD

This invention relates generally to ice cream making and packaging machines and more particularly to systems and methods for maintaining the weight of the packages within predetermined limits.

In the manufacture of ice cream or other frozen deserts, it is common practice to disperse air into the ice cream mix, to provide a desirable amount of overrun. When a predetermined volume of such ice cream is introduced into containers for consumer marketing, variations in the amount of overrun cause corresponding variations in the weight of the container contents. In continous flow ice cream making systems, it is important that the weight of the ice cream in each container be maintained within predetermined limits.

U.S. Pat. No. 4,316,490 Feb. 23, 1982, discloses a continuous flow ice cream making system which automatically controls the weight of ice cream supplied to the containers, by increasing or decreasing the amount of overrun, depending upon whether or not the cartons in a production line are overweight or underweight with respect to a desired target weight. Commercial use of the invention as disclosed in U.S. Pat. No. 4,316,490 has revealed the desirability of certain improvements. The correcting signals developed by that system in response to underweight or overweight conditions have been such that the adjustment in the amount of air dispersed in the ice cream mix is a fixed incremental amount for each correcting signal. Thus a plurality of corrections may be required in order to make an adequate correction. This necessarily extends the time required to make a substantially complete overall adjustment of the amount of overrun. In other words, there is a substantial time lag in making a correction, which has the effect of limiting the accuracy of weight control.

The apparatus utilized according to the system of U.S. Pat. No. 4,316,490, for controlling the amount of air introduced into the ice cream mix to obtain a desired degree of overrun in each of several packaging lines, employs an adjustable air regulator which supplies air to the pump which delivers the fluid ice cream mix to the continuous freezing unit. The regulator is in turn controlled by a quick start-stop reversible motor which is responsive to correcting pulses. Assuming that two or more packaging lines are involved, differing for example with respect to the flavor of the mix, each of the air regulators is controlled by a separate motor, and the separate motors are in turn controlled by the correcting pulses for the corresponding production line. This arrangement is unduly complicated. It does not lend itself to manual adjustment of the amount of air being supplied for each production line, independently of the automatic control, and it does not provide the accuracy desired.

It is an object of the present invention to generally improve upon the equipment and method of U.S. Pat. No. 4,316,490.

A further object is to provide improvements to the system and method of U.S. Pat. No. 4,316,490, which makes possible more rapid and accurate correction for overweight or underweight cartons of one or more production lines.

Another object is to provide improved means for controlling and supplying air to the ice cream mix, whereby operation and response to correcting signals is more accurate, and individual adjustments of the air supplied to each of several production lines, are facilitated.

In general the present invention is a continuous ice cream making and packaging system and method, consisting of a continuous type freezer for each production line, together with means for continuously supplying air and ice cream mix to the continuous freezer. Means controlled by correcting signals serves to supply air at a controlled rate to the mixing pump or pumps. The ice cream mix being discharged from the continuous freezer is introduced in predetermined and equal volumes into ice cream containers or cartons. The containers are carried by a conveyor which serves to continually convey the same from the packaging means through a weighing station, which serves together with electronic circuitry for deriving correcting signals. The derived signals are analog and are proportional in time to the amount of overweight or underweight of an average group of packages that have been weighed. The signals thus derived are applied to means which adjusts the amount of air being supplied to the ice cream mix. The duration of each signal is sufficient to provide full correction for overweight or underweight, or in other words, to bring the weight of the packages to target weight. The means employed for controlling the amount of air being supplied to the ice cream mix, in response to correcting signals, preferably consists of a single motor which serves to adjust a master air regulator, and the master air regulator in turn controls the setting of individual regulators which supply air to the several production lines. Also each of the regulators for the production lines are capable of individual adjustment.

Additional objects and features of the invention appear from the following description in which the preferred embodiment has been set forth in detail in conjunction with the accompanying drawing.

REFERRING TO THE DRAWING

Figure 1:
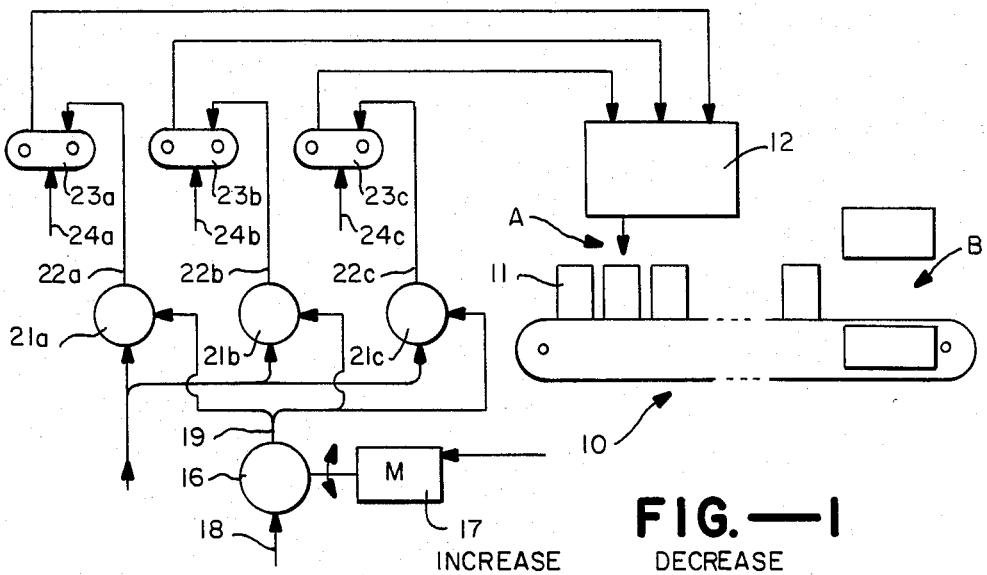
FIG. 1 is a schematic view illustrating a production line together with the means for controlling the supply of air to the ice cream mix for one or more production lines.

FIG. 1 schematically illustrates a system incorporating the invention. It consists of a conveyor 10 that serves to carry ice cream containers 11 from a filling station A to a weighing station B. At the filling station the containers each receive a measured volume of ice cream or frozen dessert. It is assumed in this instance that there are three production lines. At the weighing station each passing container is weighed to determine whether or not it is on target weight, or is overweight or underweight.

As with the system disclosed in U.S. Pat. No. 4,316,490, the ice cream as supplied to the containers is prepared from an ice cream mix that is supplied to freezers of the continuous type which discharge the ice cream with overrun and in semifluid condition. After leaving the system, the filled containers are subjected to low temperature refrigeration to harden the contents.

An improved means and method are provided for adjusting the amount of overrun. Thus a master air reducing regulator 16, which may be of the spring loaded type, has its pressure adjusting shaft coupled to the reversible electric motor 17, which is of the quick start-stop type. When the motor is energized, its shaft rotates in either direction at a constant speed. Rotation in one direction serves to increase the outlet pressure of the regulator, and rotation in the opposite direction decreases the pressure. In practice, the total angular rotation of the motor shaft in either direction is limited to the multiple turn limit of the rotatable pressure adjusting member of the regulator 16. Rotation is stopped by overtravel limiting switches disposed to be operated at either end of the travel that occurs over a full range of regulator adjustment. The inlet 18 of the regulator is connected with a source of air under pressure, which preferably is filtered. The lower pressure outlet 19 is connected to the slave regulators 21*a*, 21*b* and 21*c*, which are each of a type that has diaphragm loading consisting of both adjustable spring means and trapped air under pressure. The trapped air space in each instance is connected to the outlet 19 of the master regulator. The spring loading of each regulator 21*a*, 21*b* and 21*c*, provides a manual overriding adjustment of the outlet pressure of the same.

The outlets 22*a*, 22*b* and 22*c* of the slave regulators supply air to the mixing pumps 23*a*, 23*b* and 23*c*, which also are each supplied with a constant stream of ice cream mix of constant composition, as indicated by lines 24*a*, 24*b* and 24*c*. Air is mixed with the ice cream mix pumps 23*a*, 23*b* and 23*c*, and the aerated mix is then supplied to the continuous freezers represented by block 12.

It will be evident that with the arrangement described above, when correcting current pulses are applied to motor 17 to drive the motor shaft a predetermined angular amount in one direction or the other, the setting of master regulator 16 will be changed to increase or decrease its outlet pressure, and the outlet pressure of each of the slave regulators will be changed accordingly. It is to be understood that when the master regulator is adjusted to lower its outlet pressure, pressure in the outlet 19 is vented to the atmosphere by virtue of back pressure relief means incorporated in the regulator. This enables the outlet pressure to be reduced to the adjusted setting.

A correcting change in air pressure being supplied to each mixing pump 23*a*, 23*b* and 23*c*, serves to make a correcting change in the amount of overrun of the ice cream being discharged from the continuous freezers, at the filling station.

In practice, with the conveyor is continuous movement, the discharge of the frozen ice cream into the underlying containers can be continuous, assuming that the containers are relatively close together and the conveying rate is constant. However, the invention can be employed with an intermittent or start-stop type of conveyor, with filling of the containers during periods of pause, the volume supplied being maintained constant by metering means.

Figure 3:
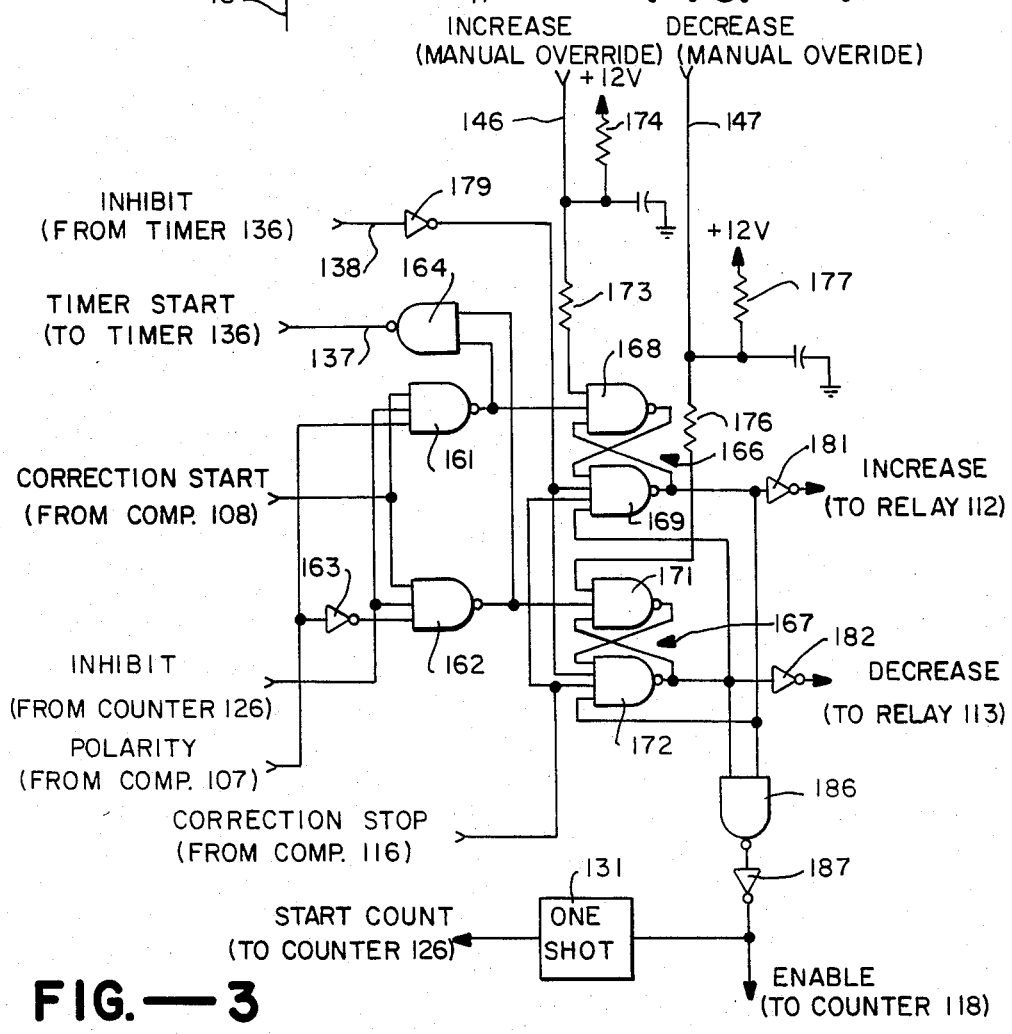
FIG. 3 is a circuit diagram of the correction logic circuit in the control circuit of FIG. 2.
Figure 2:
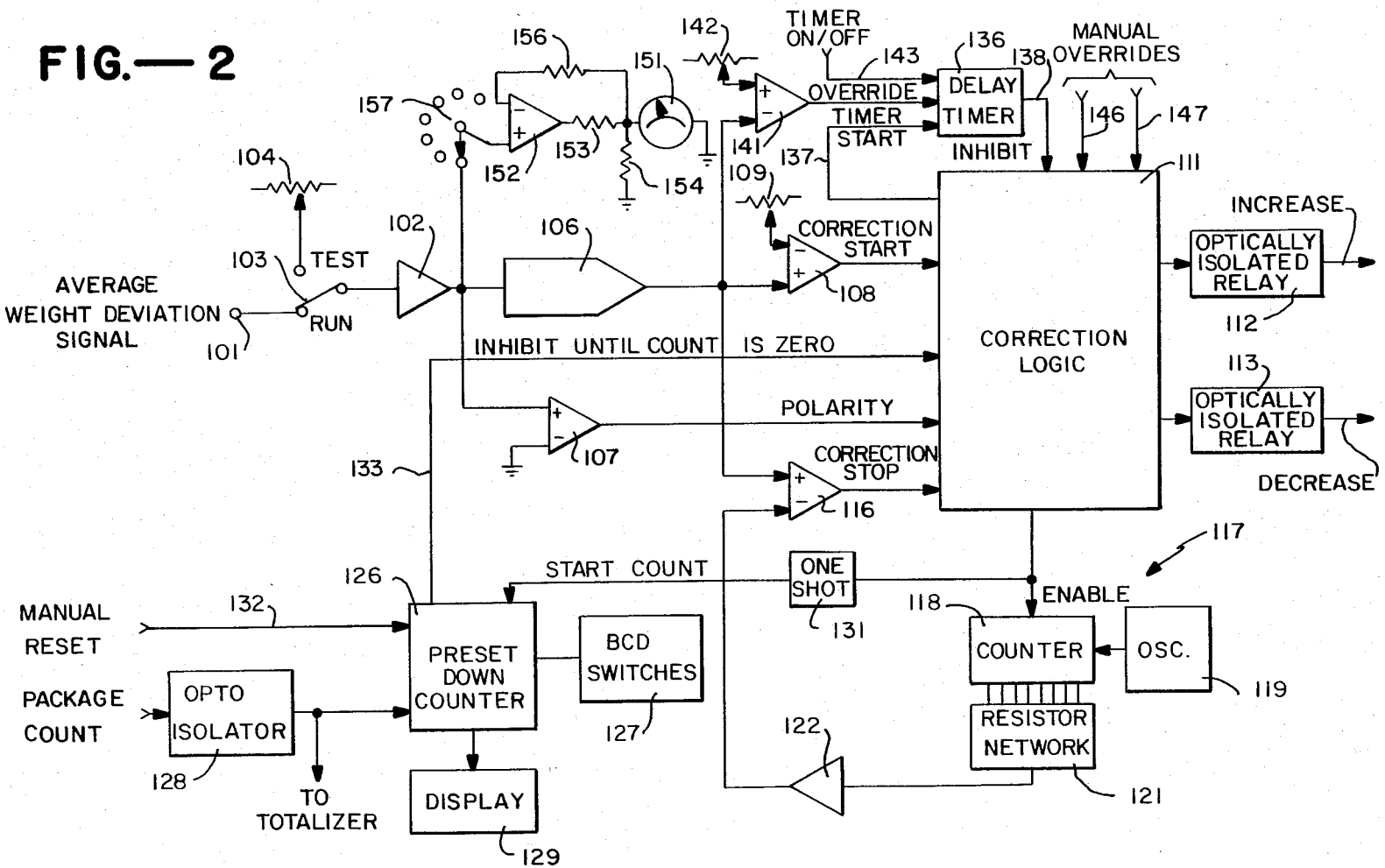
FIG. 2 is a block diagram of one embodiment of a control circuit for the ice cream making and packaging system of FIG. 1.

The electronic circuitry illustrated in FIGS. 2 and 3 generates signals that produce the desired method of operation. This method in its preferred form comprises a plurality of steps or operations. Assuming that the system is in continuous operation, and that the length of the coveyor is such that a substantial number of containers are being conveyed (e.g. 50–200) between the filling and weighing stations, and that the average weight of 10 containers is required to provide an overweight or underweight correction, the steps or operations are generally as follows.

(1) Air is continuously mixed with the incoming unfrozen ice cream mix.

(2) The mix with the added air is continuously supplied to a freezing unit of the continuous type.

(3) The ice cream discharging from the freezer is introduced into the containers being conveyed to the weighing station, in equal volumetric amounts.

(4) The containers passing through the weighing station are individually weighed and the weights of a predetermined number of successive containers (e.g. 10) are averaged.

(5) When an average weight is over or under the target weight, an analog signal is provided with a level corresponding to the amount that the average weight deviates from the target weight.

(6) A correction signal is derived from the above signal and has a time duration corresponding to the level of the analog signal and is applied to means (e.g. motor 17) which makes a correction in the amount of air supplied to the ice cream mix. The correction is in proportion to the level of the analog signal, thereby changing the amount of overrun to that which restores the containers to target weight.

In addition to the above, the preferred method includes the following.

(7) A time delay can be employed whereby more than one successive average weight signals indicative of overweight or underweight are required before a correction is made so that certain minor deviations, e.g. variations in the ingredients of the ice cream, will not produce an undesired change in the amount of air.

(8) When a container is considerably beyond the accepted average weight limit, the time delay is automatically overridden.

(9) In the event there is a drift in the weight average while a correction is being made, this modifies the amount of the correction.

(10) Once a correction has been made, further corrections are inhibited until the corrected ice cream mix is packaged and travels from the filling station to the weighing station and their weight is checked.

The electronic circuitry shown in FIGS. 2 and 3 serves to carry out the above operations.

As illustrated in FIG. 2, the control circuit has an input terminal 101 to which an average weight deviation signal is applied from the weighing station. This signal corresponds to the amount by which the average weight of a group of ice cream packages differs from the desired target weight. The signal is an analog signal having a voltage amplitude which corresponds to the amount of the deviation and a polarity which indicates whether the package weight is above or below the target rate.

The signal from input terminal 101 is applied to an input amplifier 102 via a switch 103 having TEST and RUN positions. With the switch in the RUN position, as illustrated, the average weight deviation signal is applied to the amplifier. In the TEST position, a test signal from a potentiometer 104 is applied to the amplifier. The output of amplifier 102 is connected to the input of an absolute value amplifier 106. This amplifier provides an output signal which always has the same polarity (e.g., positive) and an amplitude corresponding to the amplitude of the average weight deviation signal. The output of amplifier 102 is also connected to the (+) input of a comparator 107. The (−) input of this comparator is connected to ground, and the signal at the output of the comparator has a level corresponding to the polarity of the average weight deviation signal.

The output of amplifier 106 is connected to the (+) input of a comparator 108 which determines when the average package weight differs from the target weight by an amount such that correction of the amount of air introduced into the ice cream mix is required. The threshold level for correction is set by a potentiometer 109 which applies a reference signal to the (−) input of comparator 108. Thus, the output of this comparator remains low until the average weight of the packages derivates from the target weight by the amount set by potentiometer 109. The transition in the comparator output signal defines the start of the correction cycle which then continues for a time corresponding to the amount of correction required, as determined by the deviation of the weight signal from the target signal.

The POLARITY signal from comparator 107 and the CORRECTION START signal from comparator 108 are applied to a correction logic circuit 111 which is shown in detail in FIG. 3 and described hereinafter. The logic circuit controls the operation of a pair of optically isolated relays 112, 113 which, in turn, control the operation of the reversible motor 17 connected to the master air pressure regulator 16. Upon actuation of relay 112, the motor 17 is energized to rotate in the direction which produces an increase in the amount of air introduced into the ice cream mix, while actuation of relay 113 causes the motor to rotate in the opposite direction, producing a decrease in the amount of air. In one presently preferred embodiment, relays 112, 113 each comprise a solid state switching device such as a triac which is coupled to the logic circuit by an electro-optical isolator.

The amount of correction, i.e. the interval of time for which relay 112 or relay 113 is energized, is determined by comparing the amplitude of the average weight deviation signal with a reference signal having a level which increases with time. For this purpose, the output of amplifier 106 is connected to the (+) input of a comparator 116, and the signal from a reference signal generator 117 is applied to the (−) input of this comparator. the output signal (CORRECTION STOP) from comparator 116 is applied to logic circuit 111 to terminate the actuation of relays 112, 113.

Reference signal generator 117 comprises a binary counter 118 which has an oscillator 119 connected to its clock input. The counter receives an enabling input from logic circuit 111, and the weighted outputs of the counter are connected to a resistor ladder network 121. In the presently preferred embodiment, the values of the resistors are selected to make the output of the network increase in equal steps in staircase fashion in response to successive clock pulses from oscillator 119. The output of the resistor network is applied to the (−) input of comparator 116 via an amplifier 122. The rate at which the staircase signal increases is determined by the frequency of osicllator 119, and this frequency can be adjusted to provide the desired duration of correction. The magnitude of the correction effected by the motor 17, which operates at a constant speed, is determined by the length of time that it runs.

There is a lag in time between the time the ice cream mix passes the station where the air is introduced and the time the filled packages reach the station where they are weighed. Typically, there may be the equivalent of 50 to 200 packages between the station where air is dispersed into the ice cream mix and the weighing stations in the system of FIG. 1. To prevent overcorrection, once a correction has been made, further correction is inhibited for a period corresponding to the equivalent number of packages contained in the freezing tubes, lines etc. between the air dispersing station and the filling station and those from the filling station to the weighing station, to pass the weighing station. The delay in further correction is affected by means of a presettable down counter 126 which is preset by a binary coded decimal switch 127 to a count corresponding to a number of packages necessary to use the volume of ice cream between the air dispersing stations and the weighing station. As the packages move along the conveyor, a PACKAGE COUNT signal is applied to the clock input of the counter through the electro-optical isolator 128, and the number of packages remaining before a new correction is begun is indicated by a display 129 which is driven by the counter. The PACKAGE COUNT signal from the isolater may also be applied to a totalizer (not shown) which indicates the total number of packages which have been processed. The counter is set to the preset level determined by switches 127 in response to a signal from a one-shot multivibrator 131 which is triggered by the transition of the ENABLE signal from logic circuit 111 at the end of each correction. Counter 126 applies an inhibiting signal on line 133 to logic circuit 111 until the count in the counter reaches zero. Counter 126 can be reset to zero by a MANUAL RESET signal on reset line 132 from a manually operated reset switch (not shown).

Means is provided for inhibiting the action of the correction circuit in the event of certain minor deviations in package weight as might, for example, be encountered with ice cream mixes containing particles such as nuts and marshmallows. The number of such particles may vary from package to package, producing variations in the average weight of the packages greater than the amount set by threshold control 109. To prevent such variations from producing changes in the amount of air, a timer 136 is connected to logic circuit 111 to delay the start of correction for a time corresponding to a predetermined number of groups of overweight or underweight packages. This timer receives a starting signal on line 137 from the correction logic, and thereafter delivers an INHIBIT signal to the logic circuit on line 138 for the period of the timer.

Means is provided for overriding the action of timer 136 in the event that the average weight of the packages deviates from the target weight by a relatively large amount. This means includes a comparator 141 and a potentiometer 142. The output of amplifier 106 is connected to the (−) input of this comparator, and the potentiometer is connected to the (+) input. The signal applied to the comparator by the potentiometer sets the level at which the override occurs, and the OVERRIDE signal from the comparator is applied to timer 136 to disable the timer.

Delay timer 136 can also be overriden manually by an ON/OFF signal on line 143 from a manually operated switch (not shown).

Manual override signals can be applied to correction logic circuit 111 on lines 146, 147 to manually increase or decrease the amount of air added to the ice cream mix. These signals can be provided by manually operated switches (not shown) located on the control panel for the system.

A meter 151 is provided for monitoring the operation of the control circuit. This meter is driven by an amplifier 152 and a protective network comprising resistors 153, 154 connected as a voltage divider. A feedback resistor 156 is connected between the meter and the inverting input of amplifier 152, and the signals to be monitored are selectively applied to the noninverting input of the amplifier by a switch 157. The signals monitored in one presently preferred embodiment include the average weight deviation signal from amplifier 102, the threshold signal from potentiometer 109, the override threshold signal from potentiometer 142, the staircase signal from reference generator 117, and the power supply voltages. For ease of illustration, only a portion of the connections to switch 157 are shown in FIG. 2.

As illustrated in FIG. 3, logic circuit 111 includes a pair of 3-input NAND gates 161, 162 to which the CORRECTION START signal from comparator 108 and the INHIBIT signal from counter 126 are applied. The POLARITY signal from comparator 107 is applied directly to NAND gate 161, and its inverse is applied to NAND gate 162 by an inverter 163. The outputs of these gates are both high until the package weight deviates from the target weight by the amount set by potentiometer 109 and the count in package counter 126 has reached zero. At that time, the output of one of the gates becomes low, depending upon the direction of the deviation. Thus, for an increase in the package weight, the output of gate 161 becomes low, and for a decrease the output of gate 162 becomes low. The outputs of gates 161, 162 are connected to the inputs of a NAND gate 164, and the output of this gate is connected to timer 136 by line 137. The output of gate 164 becomes high, starting timer 136, when the output of either gate 161 or gate 162 becomes low.

The outputs of gates 161, 162 are also connected to the inputs of flip-flops 166, 167, respectively. Flip-flop 166 comprises a pair of cross-coupled NAND gates 168, 169, and flip-flop 167 comprises cross-coupled NAND gates 171, 172. The signals from gates 161, 162 are applied respectively to the upper gates 168, 171 in the flip-flops, and the manual override signals from lines 146, 147 are likewise applied to the respective upper gates. The override signal for increasing the amount of air added to the ice cream mix is applied to gate 168 through a resistor 173, and this input is held normally high by a pull-up resistor 174. The override signal for decreasing the amount of air is applied to gate 171 through a resistor 176, and this input is held normally high by a pull-up resistor 177.

The CORRECTION STOP signal from comparator 116 is applied to the lower gates 169, 172 of the flip-flops, and the INHIBIT signal from timer 136 is inverted by an inverter 179 and applied to the lower gates.

Flip-flops 166, 167 are cross-coupled in that the output of gate 169 is connected to an input of gate 172, and the output of gate 172 is connected to an input of gate 169. The outputs of the flip-flops are inverted and delivered to relays 112, 113, respectively, by inverters 181, 182 connected to the outputs of lower gates 169, 172.

Flip-flops 166, 167 are both normally in a reset condition, with the outputs of lower gates 169, 172 being high and relays 112, 113 both being deenergized. The flip-flops are held in this condition by the inverted INHIBIT signal (low) from timer 136 whenever the timer is active. At other times, flip-flop 166 can be set to energize relay 112 either by a low output signal from gate 161 or by a manual override signal on line 146. Likewise, flip-flop 167 can be set to energize relay 113 either by a low output signal from gate 162 or by a manual override signal on line 147. Because of the cross-coupling of the flip-flops, only one of them can be in a set condition at a given time, and only one of the output relays will be energized. Thus, the motor 17 which drives the air pressure regulator 16 is protected from being energized for rotation in both directions at the same time.

At the end of the correction period, the staircase signal from reference generator 117 reaches the level of the average weight deviation signal from amplifier 106, and the CORRECTION STOP signal from comparator 116 becomes low. This low signal resets the flip-flop which was set during the correction period, thereby deenergizing the output relay and the drive motor.

The outputs of flip-flops 166, 167 are also applied to the inputs of a NAND gate 186, and the output of this gate is connected to the input of an inverter 187. The output of this inverter is connected to the enabling input of counter 118 and to the trigger input of one-shot multivibrator 131.

As long as flip-flops 166, 167 are both in their reset states and their outputs are high, the output of gate 186 is low, and the output of inverter 187 is high. When one of the flip-flops switches to a set condition, the output of inverter 187 drops, thereby enabling counter 118 to start the correction interval. At the end of this interval, when the set flip-flop returns to its reset state, the output of inverter 187 again rises, turning off counter 118 and triggering one-shot multivibrator 131. The pulse from the one-shot multivibrator starts counter 126, thereby inhibiting further correction for the number of packages set by switches 127.

Referring again to FIG. 2, operation and use of the control circuit can be summarized as follows. With switch 103 in the RUN position illustrated, the average weight deviation signal from the weighing station is amplified and applied to threshold comparator 108, and the direction of any deviation from the target weight is determined by polarity comparator 107. If the input signal deviates from the target weight by more than the amount set by threshold potentiometer 109, comparator 108 fires, and if the count in counter 126 is zero and delay timer 136 is off, the correction period begins. At this time, either relay 112 or relay 113 is actuated to energize the air pressure regulator drive motor for rotation in the direction determined by the polarity signal from comparator 107. If the average weight is above the target weight, relay 112 is actuated, and the amount of air added to the ice cream is increased. If the average package weight is below the target weight, relay 113 is actuated, and the amount of air is decreased.

At the start of the correction period, counter 118 starts to count, and the output signal from resistor network 121 begins to increase in stepwise or staircase fashion. When the staircase signal reaches the level of the average weight deviation signal from amplifier 106, comparator 116 fires, deactuating the relay and terminating the correction. The length of the correction period, i.e. the amount of correction, can be adjusted by changing the frequency of oscillator 119.

At the end of the correction period, one-shot multivibrator 131 fires, starting counter 126 in its downward count, thereby inhibiting further correction until the count in this counter reaches zero and the packages in which the amount of air has been increased or decreased reach the weighing station. Thereafter, the INHIBIT signal from counter 126 is removed, and another correction period can be initiated, if necessary. If desired, counter 126 can be manually reset to zero to remove the INHIBIT signal from the correction logic by closing the reset switch connected to line 132.

If the package weight deviates from the target weight as a result of factors which do not require an adjustment in the amount of air introduced into the ice cream mix, delay timer 136 will inhibit logic circuit 111 from effecting any correction until the deviation occurs in a predetermined number of successive groups of ice cream packages. Such factors include minor variations in the contents of the ice cream, such as different numbers of nuts or marshmallows in different packages. However, in the event of a sudden deviation of larger magnitude, as determined by the setting of potentiometer 142, the action of timer 136 is automatically overriden, and an immediate correction is made. The timer can also be overriden manually by the ON/OFF switch connected to line 143.

An immediate increase or decrease in the amount of air can be effected manually by closing the switches connected to override lines 146, 147. The application of an override signal to line 146 actuates relay 112, producing an increase in the amount of air, and the application of an override signal to line 147 actuates relay 113, producing a decrease in the amount of air.

Since the average weight deviation signal is monitored continuously, any change in this signal during a correcion is reflected in the output of amplifier 106, and the duration of the correction period (i.e., the amount of correction) is thus automatically adjusted in accordance with this change.

The control circuit can be tested by placing switch 103 in the TEST position and adjusting potentiometer 104 to simulate the average weight deviation signal, and the operation of the circuit can be monitored by applying signals from different points to meter 151 via selector switch 157.

The circuitry described above may serve for more than one production line, provided the variation in weight of the filled containers are of comparable magnitude. Variations due to difference between production lines can be accommodated by manual adjustments of the slave regulators 21*a*, 21*b* and 21*c*.

What is claimed is:

1. A continuous ice cream making and packaging system comprising a continuous type freezer, means for continuously supplying a mixture of air and ice cream mix to the freezer, means for continuously packaging predetermined and equal volumes of ice cream in containers, conveying means for continually conveying the containers of ice cream from said packaging means through a weighing station, means for deriving a correcting signal when an average group of containers is overweight or underweight relative to a desired target weight, said signal being of a duration corresponding to the amount that the group is overweight or underweight relative to the desired target weight, and means responsive to said signal for adjusting the amount of air supplied to the ice cream mix, said means serving to correct the amount of air supplied in accordance with the duration of the correcting signal, whereby the correction brings the average weight to target weight.

2. A system as in claim 1, together with time delay means serving to prevent correcting changes in the amount of air supplied to the ice cream mix, when the weight of an average group of packages differs from, but is relatively close to package weight.

3. Apparatus as in claim 1 in which the means for supplying air to the ice cream mix consists of pressure regulating means having pneumatic pressure loading, the rate of discharge of air from the regulating means varying in accordance with changes in the pneumatic loading, a master pressure reducing regulator connected to supply air to the first named regulator, a reversible electric motor connected to adjust the loading of the master regulator, means responsive to said correcting signal for causing the motor to be energized for clockwise or counterclockwise rotation, the amount of correcting rotation being such that the master regulator is adjusted to supply more or less air to the first named regulator to adjust the loading of the same and thereby effect a correction in the weight of the filled containers in accordance with the said signal.

4. Apparatus as in claim 3 in which said first named regulator is provided with both spring loading and pneumatic air pressure loading, and has means for adjusting said spring loading.

5. A continuous method for the manufacture of packaged ice cream comprising the following steps:

(a) Continuously mixing air in a controlled amount with an unfrozen ice cream mix, (b) Continuously delivering the mix to a freezing unit of the continuous type whereby it is incorporated in the mix to produce ice cream with overrun, (c) Continually discharging equal volumes of ice cream into packaging containers, (d) Continually conveying the containers through a weighing station, (e) Weighing the filled containers as they are conveyed through the weighing station and deriving an underweight signal when a predetermined number comprising a group of containers is underweight and an overweight signal when such group is overweight, the durations of the signals being in accordance with the amount of overweight or underweight of the group, and (f) Automatically adjusting the amount of air supplied to the mix responsive to the said underweight or overweight signal, the amount of air incorporated in the mix being increased responsive to overweight signals and decreased responsive to underweight signals whereby the weights of the filled containers are brought to target weight.

6. A method as in claim 5 in which the overweight and underweight signals serve to control the energizing of an electrical motor to rotation of the motor shaft in one direction or the other through an angle that is proportionate to the duration of the correcting analog signal, such rotation of the motor shaft serving to effect a correction in the amount of air supplied.

7. A method as in claim 5 or 6 in which a time delay is imposed to prevent small changes in the average product weight from effecting a correction in the amount of air supplied.

* * * * *